US005507237A

United States Patent [19]

Barrow et al.

[11] Patent Number: 5,507,237

[45] Date of Patent: Apr. 16, 1996

[54] LIFTING APPARATUS FOR USE WITH BULK BAGS

[76] Inventors: David A. Barrow, 10622 Allyson, Baton Rouge, La. 70815; Blake Whitlatch, 6067 Chateau Loire, Mandeville, La. 70448

[21] Appl. No.: 283,581

[22] Filed: Aug. 1, 1994

[51] Int. Cl.[6] ..... B65D 19/44

[52] U.S. Cl. ..... 108/55.1; 108/55.3; 108/56.1; 108/53.1; 206/600

[58] Field of Search ..... 108/55.1, 55.3, 108/56.1, 53.3, 51.1, 53.1; 206/600

[56] References Cited

U.S. PATENT DOCUMENTS

| | | | |
|---|---|---|---|
| 2,553,273 | 5/1951 | Phillips | 108/55.1 X |
| 2,576,715 | 11/1951 | Farrell | 108/55.1 X |
| 2,956,763 | 10/1960 | D'Arca | 248/120 |
| 3,168,060 | 2/1965 | Farley | 108/53 |
| 3,289,613 | 12/1966 | Evans | 108/53 |
| 3,327,889 | 6/1967 | Dorc | 108/55.1 X |
| 3,401,651 | 9/1968 | Carlström | 108/51 |
| 3,405,665 | 10/1968 | Slonim | 108/55.1 |
| 3,499,398 | 3/1970 | Murray | 108/53 |
| 3,502,237 | 3/1970 | Verhein et al. | 108/53.1 X |
| 3,857,494 | 12/1974 | Giardini | 211/177 |
| 4,201,138 | 5/1980 | Cox | 108/55.1 |
| 4,221,296 | 9/1980 | Fell et al. | 206/600 |
| 4,265,184 | 5/1981 | Cox | 108/55.1 |
| 4,292,901 | 10/1981 | Cox | 108/55.1 |
| 4,295,431 | 10/1981 | Stavlo | 108/55.1 |
| 4,353,520 | 10/1982 | Jansson | 248/346 |
| 4,372,221 | 2/1983 | White | 108/55.3 X |
| 4,729,483 | 3/1988 | Schrader | 211/153 |
| 5,056,666 | 10/1991 | Janssens | 108/56.3 X |
| 5,056,667 | 10/1991 | Coogan | 206/600 |
| 5,078,415 | 1/1992 | Goral | 240/79.2 |

FOREIGN PATENT DOCUMENTS

| | | | |
|---|---|---|---|
| 2657787 | 6/1978 | Germany | 108/51.1 |
| 319429 | 12/1970 | Sweden | 108/55.1 |
| 2242891 | 10/1991 | United Kingdom | 206/600 |

*Primary Examiner*—Peter M. Cuomo
*Assistant Examiner*—Janet M. Wilkens
*Attorney, Agent, or Firm*—Pravel, Hewitt, Kimball & Krieger

[57] ABSTRACT

A bulk bag lifting apparatus includes a structural frame having beams that accept forklifting tines during lifting operations from below and lugs at the top of the frame which facilitate jerking lifts from above. The base has a peripheral side wall that is fixed and structurally connected to the base. A plurality of four moving side wall portions are provided which can collapse upon the base and below the upper edge of the peripheral side wall. In this fashion, a number of different units can be stacked when the units are in a collapsed position. The side walls collapse in pairs including opposed diagonally opposite side walls collapsing at the same time and a pair at a time. In this fashion, a first two of the side walls can collapse into a position upon the base wherein the first two side walls are generally side by side and occupying different half base portions of the base. The second two side walls are also diagonally opposed and are spaced ninety degrees (90°) with respect to the first two collapsing side walls so that the second two side walls collapse upon the first side walls. The second two side walls likewise are diagonally opposite and collapse upon half portions of the base.

19 Claims, 2 Drawing Sheets

LIFTING APPARATUS FOR USE WITH BULK BAGS

BACKGROUND OF THE INVENTION

1. Field of the Invention

The present invention relates to oil and gas well drilling and more particularly relates to the management of oil and gas well drilling fluids and even more particularly to a method and apparatus for transporting bulk quantities of dry drilling material to and from an oil and gas well drilling structure wherein a rigid basket houses and supports a flexible bulk bag (such as the one shown in U.S. Pat. No. Re. 34,560), the basket including a structural base for lifting from the bottom and lugs for lifting from above and a plurality of folding sides that are collapsible after the bulk bag has been emptied.

2. General Background

There are many dry powder products used as drilling mud components. Many of the products must be protected from the slightest amount of moisture in a sealed tank such as caustic soda and XCD polymer. Many of these products are not affected by moisture; such as fibers, lignite, and bentonite.

Many drilling products can be transported via bulk bag. Bulk bags are made of synthetic polymers and plastics. Bulk bags are designed with a safety factor of 5 to 1 in most cases. The bag is not guaranteed from tearing because of improper handling or from overload. The bag will also deteriorate over time as well. The bulk bag has a limited number of lifts it can endure. It is not possible for the bulk bag to safely support the drilling mud products that it carries through the numerous lifts it must endure.

The operators have palletized materials delivered to the location. The palletized materials can be stored in low overhead areas. Palletized material can be stacked on each other due to the structural strength the small bags provide through bond stacking. The primary support for lifting comes from the wooden pallet the bags sit on. The pallet can be lifted with fork trucks and pallet lifting crane devices. Once the material is used, the pallets are stacked and sent back utilizing minimum space on transport vehicles and vessels.

The wooden pallet has inherent problems. It does not protect the product from the fork truck tongs and is easily broken by improper handling. It does not give the stacked bags a total structural support necessary for handling, balancing and stacking. Pallets are manufactured using forest products, the drilling fluids industry accounting for 450,000 pallets in 1991. If the industry is going to eliminate the use of wooden pallets, paper sacks, and plastic shrink-wraps for environmental reasons, it must change to a reusable/recyclable system.

If the industry is going to change to a more ecological friendly system the bulk bag must be used. The only way the bulk bag can be used in the industry is to allow it the same luxuries the palletized material system did. This primarily being rig storage areas and rig equipment designed for palletized material and minimum space required for transporting empty pallets and sacks versus an empty tank.

A number of patents have issued which relate to pallets for transporting various products. U.S. Pat. Nos. 4,729,483; 2,956,763; 3,499,398; and 4,353,520 all show pallets having frames with sockets for accommodating the tines of a forklift and sidewalls, some of which are folding or collapsing.

U.S. Pat. Nos. 3,857,494; 3,168,060; 3,289,613; 4,295,431, and 5,078,415 all discuss pallet lifting devices with removable side supports.

A mobile carrier for gas cylinders is the subject of U.S. Pat. No. 5,078,415 issued to Norbert Goral. The '415 patent provides a mobile carrier capable of carrying a number of gas cylinders comprising a generally horizontal first support surface with at least three wheel supports rigidly attached to it, each wheel support including a rotatably mounted wheel. The wheel supports are off-set laterally relative to the first support surface, the first support surface being below the top of at least one wheel support. An upright frame rigidly connected to the first support surface extends around three sides of the carrier. A second support surface is pivotally connected to an outside edge of the first support surface along a fourth open side of the carrier. The second support surface is pivotable between an upright position, where it may be secured to the frame, and a lowered position in which the second support surface is supported on another surface so that a gas cylinder may be moved between the mobile carrier and another surface by rolling the container about its axis between the first support surface and the other support surface along the second support surface.

U.S. Pat. No. 4,729,483 issued to Donald E. Schrader provides a deck member for a storage rack in which the front and rear portions of the deck member are provided with the front and rear planar platform surfaces including correspondingly upwardly projecting transverse front and rear ridge members having a front-to-rear dimension of a storage container received on the deck member, to retain the storage container upon the deck member.

U.S. Pat. No. 4,353,520 issued to Hadar J. E. Jansson relates to an apparatus in large open goods carriers, so called container-flats, which display a loading plant and at least one wall unit, for example an end wall unit, which is fixedly retained in the loading plane for pivotal switching from a rest position, in which the wall unit is located in or parallel with the loading plane, and a working position, in which the wall unit makes substantially a right angle with the loading plane. The anchorage of the wall unit consists of a hinge means with a shaft in or on which one end of at least one torsion bar is disposed in a non-rotary manner, the torsion bar extending longitudinally with the pivotal shaft of the pivotal wall unit the other end of the torsion bar being disposed in a non-rotary manner in the loading plane, and that the torsion bar is tension-free in a position on the wall unit between its rest position and working position.

A pallet for receiving, retaining and facilitating the transportation of pressurized gas cylinders is the subject of the '431 patent issued to Lars G. Stavlo. The pallet includes three fixed, upstanding fence-like side walls and a pair of upper and lower gate members defining a fourth, openable side wall. The fixed upstanding side walls extend around three sides of the perimeter of a generally rectangular floor structure. Posts are provided at the four corners of the floor structure and extend upwardly above the top surface of the floor structure. The upper gate member is nonreleasably but movably connected to a second one of the posts. The upper gate member is movable between a retaining position extending between the first and second posts, and a loading position nested within the first of the posts. The lower gate member is pivotally connected near its lower edge to the floor structure for movement between an upstanding retaining position and a downwardly extending loading position wherein the lower gate member forms a ramp to facilitate the loading and unloading of gas cylinders onto and off of the top surface of the floor structure. A latching collar is slidably carrier on one of the first and second posts for engaging the lower gate member to releasably latch the lower gate member in its retaining position.

U.S. Pat. No. 4,292,901 issued to Clayton E. Cox provides a cornerboard for a pallet which is fabricated from a suitable material; in one embodiment it is molded of a plastic and in another it is made of sheet steel sections. The cornerboards may be provided with a variety of interlocking sections and spacer members so that packages of different sizes can be accommodated by selecting the proper length of the sections and/or spacers.

Another patent issued to Cox, U.S. Pat. No. 4,265,194 provides an improved cornerboard for a pallet wherein the main portion consists of two L-shaped metal sections with complementary tongues and slots so that the cornerboard height can be readily adjusted. The cornerboard is easily fabricated from steel sheet sections utilizing conventional bending, stamping and welding techniques.

U.S. Pat. No. 4,201,138, also issued to Clayton E. Cox, deals with an improved cornerboard for a pallet wherein conventional boards are equipped with top and bottom caps which may be fabricated of a suitable hard material such as plastic or metal. The cornerboard caps of that invention protect the ends of the cornerboards from damage and also hold them in the correct right angle alignment. Cornerboard caps may be fitted with top portions which further protect material on a pallet. In accordance with one embodiment of the invention, filler sections may be employed so that a given set of cornerboards can accept loads of different heights.

U.S. Pat. No. 3,857,494 issued to Giardini provides a modular rack assembly for storing and shipping massive metal articles which includes a rigid rectangular base having a vertically disposed leg fixed at each corner and a post member extending vertically above and supported by each leg. The legs and post members include means providing a pair of open, interfacing vertically aligned grooves at each side of the rack assembly for slidably receiving and laterally supporting the opposite ends of side members disposed on edge along each side of the rack assembly to provide a load bearing side wall at each side of the rack assembly.

A portable storage rack or pallet having foldable end frames used in the shipment and/or conveying of articles is the subject of U.S. Pat. No. 3,499,398 issued to J. M. Murray. More particularly, the '398 patent provides a storage rack or pallet including a platform with foldable end frames hingedly connected thereto, and still more particularly a storage rack or pallet having end frames movable between upright and folded positions to facilitate shipping of the frames after usage.

U.S. Pat. No. 3,401,651 issued to Roland Carlstom provides a load carrying pallet having a rectangular bottom frame, pillars located at the corners of the frame and hingedly connected to the frame and lateral supports hingedly connected to said pillars, so that the pillars with the supports may be easily swung from an upright position to a lying position upon the frame and vice versa.

A stacking frame assembly for a pallet is the subject of U.S. Pat. No. 3,289,613 issued to George Q. Evans. The '613 patent relates to a stacking frame assembly for a pallet and more particularly to a frame which is secured to a pallet whereby a pallet may be stacked on top of the frame and in which the frame is readily detachable from the pallet to which it is secured.

U.S. Pat. No. 3,168,060 issued to Arthur C. Farley relates to pallet stacking devices of the character which permit a fork lift truck to mount pallets successively on top of one another for storage of material in a depot or in a warehouse.

U.S. Pat. No. 2,956,763 issued to Nicholas A. D'Arca relates to pallets for storing and transporting articles and more particularly to improvements in collapsible and tierable pallets or tote racks.

SUMMARY OF THE INVENTION

The present invention comprises a method of handling drilling fluid products and like products in bulk bags. The apparatus of the present invention comprises a basket which has collapsing side walls such that the apparatus can collapse to less than ½, more preferably less than ⅓, and most preferably less than ¼ of its height when open. The method comprises placing a bulk bag in the apparatus and using a fork lift or other lifting device to pick up and transport the apparatus.

The apparatus of the present invention comprises a base member with rectangular corners, and having a plurality of spaced apart beams, each of the beams being arranged in generally parallel fashion and each beam having a hollow channel. The apparatus also includes a frame including a fixed peripheral side wall portion that extends around the outer periphery of the base and above the beams, and a plurality of four movable side walls. Each of the side walls is pivotally attached to the base at the periphery thereof, and each of the side walls includes a generally rigid structural half-wall member that extends from a position adjacent a corner of the base and terminating at a position that is less than the width of one side of the base. The plurality of side walls are collapsible in pairs including a first collapsing pair that collapses adjacent each other and in side to side relation wherein the center edge portion of one side wall communicates with the central edge portion of the opposing side wall in a collapsed position.

The apparatus of the present invention for transporting bulk materials comprises a portable, collapsible basket for bulk bags. The basket comprises a bottom, four collapsible side walls, and an open top. There is a peripheral wall means adjacent the bottom. The four collapsible side walls comprise two pairs of parallel side walls, each side wall including a wall portion having a length less than half that of the basket, the wall portions in the walls in each pair of side walls being diametrically opposed to one another, each wall also including a strap portion, the walls in each pair being able to fold downward side-by-side. First pin means pivotally connect each collapsible side wall to the peripheral wall means. There are also means for detachably connecting each collapsible side wall to the peripheral wall means. Fork-lift tine means allow the basket to be transported with a fork lift.

The fork-lift tine means preferably comprises two pairs of fork-lift tine channels in the bottom, the two pairs being coplanar, perpendicular to one another, and intersecting one another, the fork-lift tine channels being shaped to prevent contact of fork-lift tines therein with a bulk bag contained in the basket or, when the basket is stacked on a like basket, a bulk bag contained in the like basket. Having the fork-lift tine channels be coplanar allows the height of the basket to be kept at a minimum.

All fork lift tine channels are preferably in the same plane to minimize the height of device when stacked; the channels intersect; the channels are completely contained to prevent fork lift tines from cutting a bag in a lower basket when the baskets are stacked one upon another.

There are preferably first slot means for limiting movement of the basket when the basket is stacked upon another like basket and second slot means for engaging hydraulic wheels of a pallet jack.

To facilitate use of the baskets offshore, there are preferably lifting-eye means in at least two of the collapsible side walls. The lifting-eye means allow the basket of the present invention to be easily lifted with a crane.

To accommodate the nipple in the bottom of bulk bags, there is preferably an opening in the bottom of the basket.

The walls are connected to the peripheral wall portion in such a manner that the collapsible walls are all below the upper edge of the peripheral wall portion when the basket is in the collapsed position.

The present invention includes a method of transporting bulk materials in a marine environment, comprising placing a bulk bag in the apparatus of the present invention and attaching a lifting means to the apparatus of the present invention.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein:

FIG. 2A is a fragmentary view taken along lines 2A—2A of FIG. 2;

Figure 3:
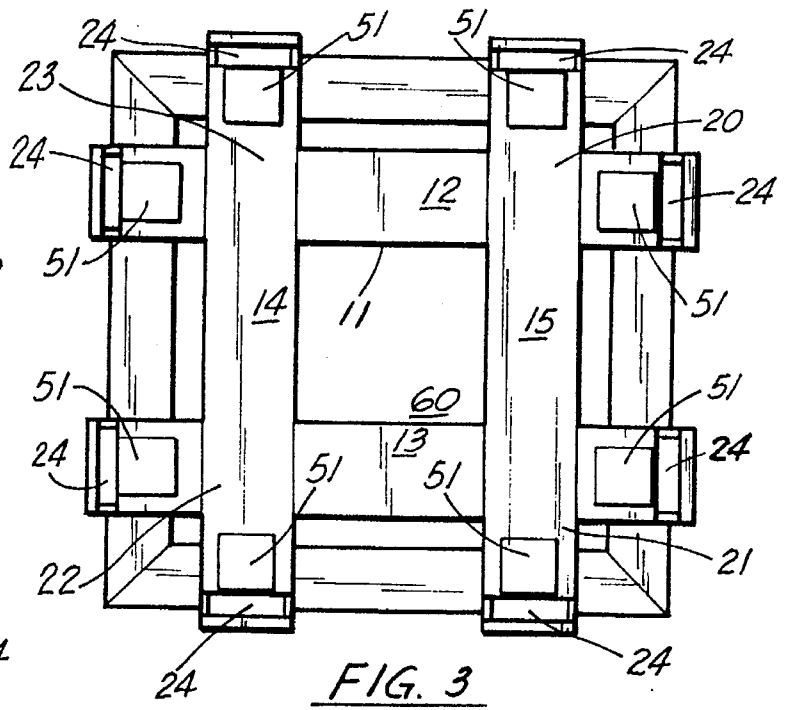
FIG. 3 is a bottom view of the preferred embodiment of the apparatus of the present invention.

DETAILED DESCRIPTION OF THE PREFERRED EMBODIMENT:

FIGS. 1–4 illustrate the preferred embodiment of the apparatus of the present invention designated generally by the numeral 10. Bag lifting apparatus 10 can be used in combination with very large bulk bags, such as the one which is shown in phantom lines as B in FIG. 1. A bulk bag is a commercially available bag that can carry as much as four cubic yards of dry material such as the dry drilling materials that are necessary in oil and gas well drilling operations. A bulk bag which could be used in conjunction with the present invention is disclosed in U.S. Pat. No. Re. 34,560. Such dry drilling materials includes drilling mud, drilling mud additives, and the like.

Bag lifting apparatus 10 includes a structural base 11 that is comprised of a plurality of intersecting beams 12, 13, 14 and 15. The beams 12, 13, are generally parallel. The beams 14, 15 are generally parallel. The beams 12, 13 intersect at ninety degrees (90°) the beams 14, 15 as shown in FIG. 3.

A plurality of intersections 20, 21, 22, and 23 (see FIG. 3) are defined by the intersection of beams 12, 13 with the beams 14, 15. However, it should be understood that the intersection of beams 12, 13 with beams 14, 15 does not interfere with the open channels 16, 17 and 18, 19 respectively that traverse the beams 12, 13 and 14, 15. The channels 16–19 are open-ended so that a pair of forklift tines (not shown) can fully penetrate a selected pair of beams respectively 12, 13 or 14, 15 so that either pair of beams 12, 13 or 14, 15 can be selected for lifting the apparatus with a forklift. Slots 51 accommodate the hydraulic wheels of a pallet jack so that a pallet jack can be used to transport apparatus 10.

An opening 60 formed by intersecting beams 12–15 allows a bulk bag (not shown, but for example one of the type shown in U.S. Pat. No. 4,224,970) to rest flat on the bottom of apparatus 10 by allowing the nipple of the bulk bag to fit therein.

Figure 4:
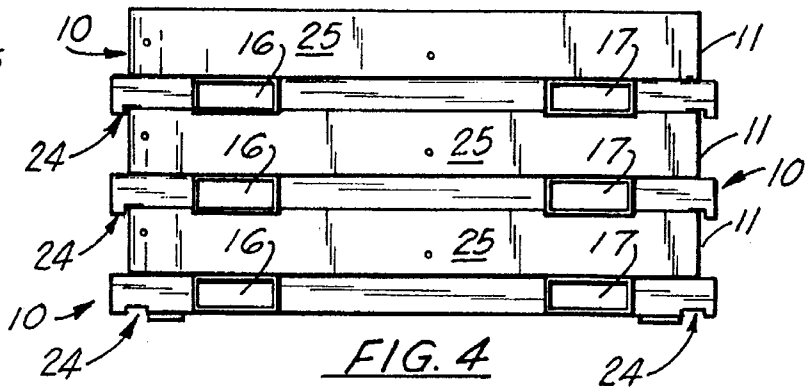
FIG. 4 is a side view of the preferred embodiment of the apparatus of the present invention showing collapsed configuration and a plurality of stacked units.

Each beam 12–15 has a slot 24 at each end thereof and on the underside thereof as shown in FIG. 3. The slots 24 communicate with the upper edge 26 of peripheral wall 25 when a plurality of bag lifting apparatus 10 are stacked as shown in FIG. 4.

Figure 1:
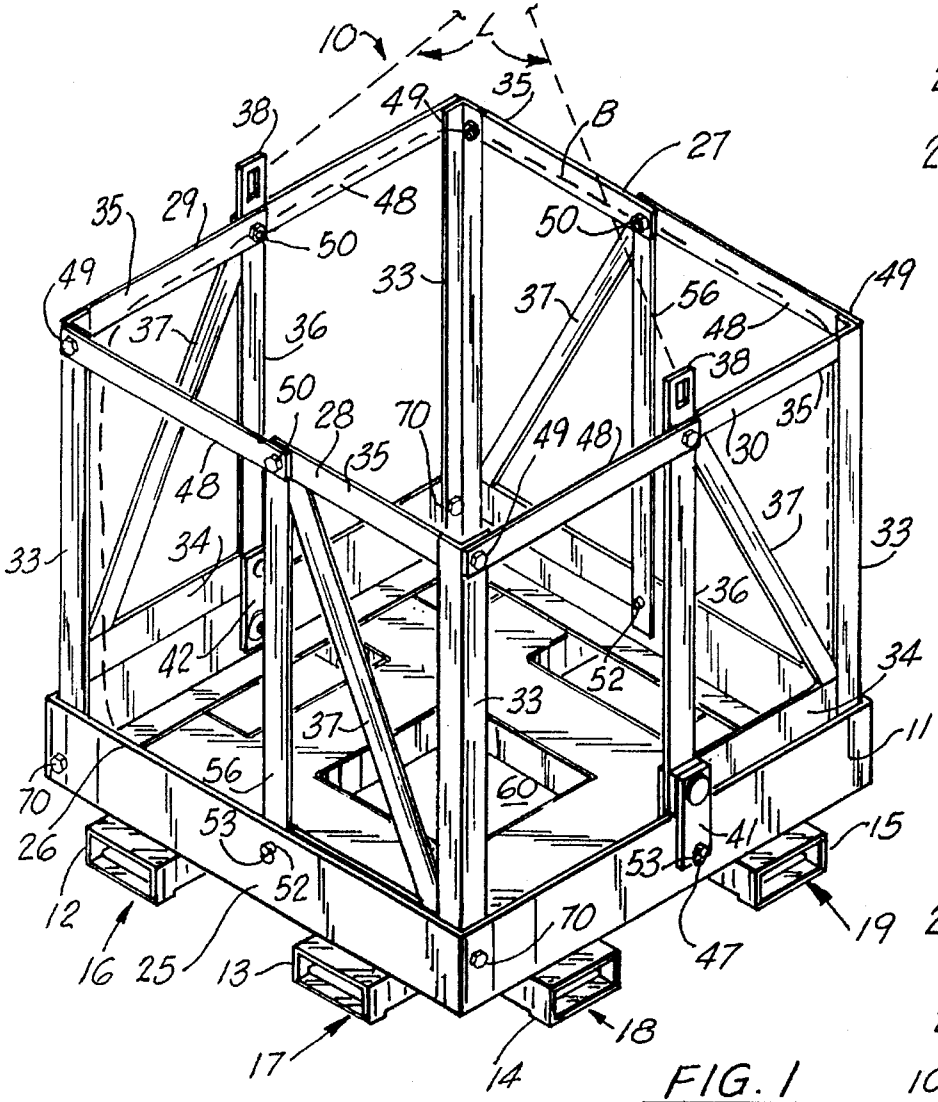
FIG. 1 is a perspective view of the preferred embodiment of the apparatus of the present invention.
Figure 2:
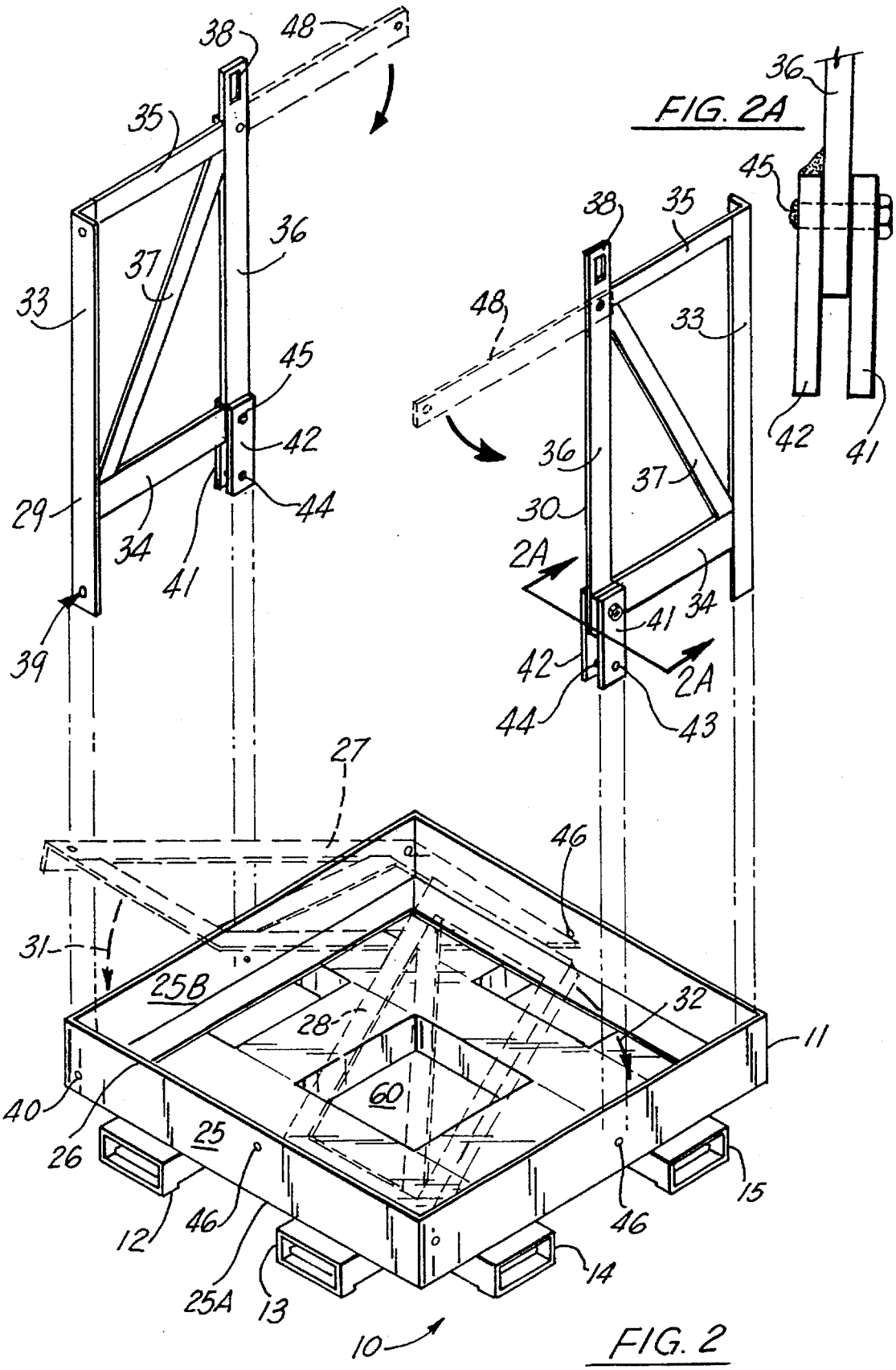
FIG. 2 is an exploded perspective view of the preferred embodiment of the apparatus of the present invention.

Peripheral wall 25 confines the lower end portion of a bulk bag B. The peripheral wall 25 also supports a plurality of collapsible side walls in a fully upright position as shown in FIG. 1. In FIG. 2, the four side walls 27, 28, 29, and 30 are shown. The side walls 27, 28 are shown in phantom lines and in a transition between fully upright and folded positions. Arrows 31, 32 illustrate a folding of walls 27, 28 into a collapsed position. In the fully collapsed position, each of the side walls 27, 28 and 29, 30 is fully collapsed upon base 11 and within peripheral wall 25. Further, the side walls 27, 28, 29, 30 when collapsed are fully contained below upper edge 26 of peripheral side wall 25. In the fully collapsed position, a plurality of bag lifting apparatus 10 can be stacked as shown in FIG. 4.

Each side wall 27, 28, 29, 30 includes a corner beam 33, lower horizontal beam 34, and an upper horizontal beam 35. Side walls 29 and 30 have a center beam 36. The center beam 36 includes a lift eye 38 at its upper end portion. Side walls 27 and 28 include a center beam 56. Diagonal beam 37 can be used to rigidify side walls 27, 28, 29, 30.

Each side wall 27, 28, 29, 30 is connected to peripheral side wall 25 with a pivotal connection using pins 70. The corner post 33 carries an opening 39 that is affixed to peripheral side wall 25 at a similar opening 40 using a bolted or pinned connection for example. Openings 39, 40 associated with side walls 29, 30 are lower than openings 39, 40 associated with side walls 27, 28 to allow walls 27, 28 to rest flat on walls 29, 30 after walls 29, 30 are folded down.

A second connection is formed between each movable side wall 27–30 and the fixed peripheral wall 25. The second connection is a removable pinned connection that is formed between a pair of flanges 41, 42 and peripheral side wall 25. Each of the flanges 41, 42 includes an opening 43, 44 respectively at the lower end portion thereof. Flange 42 is permanently attached as by welding to beam 36. Flange 41 is rotatably attached at rotating connection 45 to the intersection of beams 34, 36. In order to secure the flanges 41, 42 to peripheral side wall 25, the flange 41 is placed on the outside surface 25 A of peripheral side wall 25 and the flange 42 is placed on the inside surface 25 B of peripheral wall 25 (see FIG. 2). The openings 43, 44 are aligned with the opening 46 in peripheral side wall 25. The removable pin 47 is then placed through openings 43, 46, and 44 in that sequence. In order to collapse a particular selected movable side wall 29, 30, the pin 47 is removed and the flange 41 is rotated until flange 41 clears the upper edge 26 of peripheral side wall 25. Alternatively, flange 42 could also be pivotally mounted to the beams 34, 36. In this fashion, flange 41 and flange 42 could both be rotated until they align with the lower horizontal beam 34 and then the side wall 29, 30 collapsed.

Side walls 27, 28 each have a pin 52 in center post 56 in place of flanges 41, 42 and pin 47 in center post 36. When pins 52 are removed, walls 27, 28 can be collapsed as shown in FIG. 2. Alternatively, sidewalls 27, 28 could have center posts 36, flanges 41, 42, and pin 47 instead of center posts 56 and pins 52, if additional support were deemed desirable.

Upon assembly of the plurality of side walls 27, 28, 29, 30 in a fully upright position (FIG. 1) a plurality of horizontal straps 48 are used to secure one side wall 27 to its adjacent side wall 30 as shown in FIG. 1. The straps 48 are pinned using a removable pinned connection 49 to corner post 33. Each strap 48 is bolted at bolted connection 50 to the intersection of horizontal beam 35 and center post 36 or 56. In order to detach a selected strap 48 from its adjacent side wall, the removable pinned connection 49 is disconnected, and strap 48 is allowed to pivot downwardly so that it is parallel to the center post.

Straps 48 are short enough that, when parallel to beam 36, they do not touch flange 41.

Horizonal beams 34 and 35 have a length less than one half of the distance between parallel sides of peripheral side wall 25; walls 27 and 28 are diametrically opposed, as are walls 29 and 30. In this manner, when walls 27, 28, 29, and 30 are collapsed, walls 27 and 28 can fold downward side-by-side, instead of having one of these walls rest upon the other; likewise, walls 29 and 30 can fold downward side-by-side. This is advantageous in that walls 27–30 can fold up in less vertical space than if beams 34 and 35 were long enough such that walls 27 and 28 and 29 and 30 could not fold down side-by-side.

The apparatus 10 of the present invention can be manufactured of any suitable structural material such as welded steel or the like. The bulk bags B are commercially available of a heavy woven material as is known in the art.

Pins 47, 49, and 52 can be standard smooth bolts with a cotter-pin opening through one end thereof to receive cotter pins 53 therein (see FIG. 1).

To close up the apparatus of the present invention, one first removes pins 49 of all walls and allows the horizontal straps 48 to pivot downwardly so that they are parallel to beam 36. One then removes cotter pins 53 of pins 47 and removes pins 47. He then allows walls 29 and 30 to pivot downward on pins 70 until walls 29 and 30 rest, side by side, adjacent the floor of apparatus 10. He then removes cotter pins 53 of pins 52 and removes pins 52. He then allows walls 27 and 28 to pivot downward on pins 70 until walls 27 and 28 rest, side by side, adjacent walls 29 and 30.

Lift eyes 38 project above horizontal beams 35 a distance less than the height of channels 12, 13, 14, 15, so that two baskets of the present invention can be stacked one upon the other when both baskets are in the open position, without damaging lift eyes 38.

Connecting the basket together with pins allows the walls to be unpinned should a bag get stuck in the basket, thus facilitating the unsticking of the bag.

Baskets 10 are sized to contain commercially available bulk bags, such as those shown in U.S. Pat. No. Re. 34,560 or U.S. Pat. No. 4,224,970. Exemplary dimensions for the bulk bags are up to five feet wide by five feet long by six feet tall with a 20–100 cubic foot capacity and able to hold 2,000–15,000 lbs. of material. Preferred dimensions for the basket 10 are 3½ feet to six feet in height, 3½ feet to six feet in length, and 3½ feet to six feet in width. Exemplary dimensions for the basket 10 are five feet in height, 5½ feet in length, and 5½ feet in width.

As shown in FIG. 1, a lifting means L, such as cables from a crane, can be attached to lifting eyes 38. This allows a crane to pick up apparatus 10.

The following table lists the part numbers and part descriptions as used herein and in the drawings attached hereto.

PARTS LIST

| Part Number | Description |
|---|---|
| 10 | bag lifting apparatus |
| 11 | base |
| 12 | beam |
| 13 | beam |
| 14 | beam |
| 15 | beam |
| 16 | open channel |
| 17 | open channel |
| 18 | open channel |
| 19 | open channel |
| 20 | intersection |
| 21 | intersection |
| 22 | intersection |
| 23 | intersection |
| 24 | slot |
| 25 | peripheral wall |
| 26 | upper edge |
| 27 | side wall |
| 28 | side wall |
| 29 | side wall |
| 30 | side wall |
| 31 | arrow |
| 32 | arrow |
| 33 | corner post |
| 34 | horizontal beam |
| 35 | horizontal beam |
| 36 | center post |
| 37 | diagonal beam |
| 38 | lifting eye |
| 39 | opening |
| 40 | opening |
| 41 | flange |
| 42 | flange |
| 43 | opening |
| 44 | opening |
| 45 | connection |
| 46 | opening |
| 47 | pin |
| 48 | horizontal strap |
| 49 | pinned connection |
| 50 | bolted connection |
| 51 | slot |
| 52 | pin |
| 53 | cotter pin |
| 56 | center post of sides 27, 28 |
| 60 | opening in bottom for nipple of bulk bag |
| 70 | pin for pivotal connection |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A bulk bag lifting apparatus comprising:

a) a base member with rectangular corners, and having a plurality of spaced apart beams, each of the beams being arranged in generally parallel fashion and each beam having a hollow channel;

b) a frame including a fixed peripheral side wall portion that extends around the outer periphery of the base member and above the beams;

c) a plurality of four movable side walls, each of the side walls being pivotally attached to the frame at the periphery thereof, each of the side walls including a generally rigid structural half wall member that extends from a position adjacent a corner of the base member and terminating at a position that is less than the width of one side of the base member;

d) the plurality of side walls being collapsible in pairs including a first collapsing pair that collapses adjacent each other and in side-to-side relation wherein the center edge portion of one side wall communicates with the central edge portion of the opposing side wall in a collapsed position.

2. Apparatus for transporting bulk materials, comprising a portable, collapsible basket for bulk bags, the basket comprising:

(a) a bottom;

(b) four collapsible side walls, comprising two pairs of parallel side walls, each side wall including a wall portion having a length less than half that of the basket, the wall portions in the walls in each pair of side walls being diametrically opposed to one another, each wall also including a strap portion, the walls in each pair being able to fold downward side-by-side;

(c) an open top;

(d) a peripheral wall means adjacent the bottom;

(e) first pin means pivotally connecting each collapsible side wall to the peripheral wall means;

(f) means for detachably connecting each collapsible side wall to the peripheral wall means; and (g) fork-lift tine means for allowing the basket to be transported with a fork lift.

3. The apparatus of claim 2, wherein the fork-lift tine means comprises two pairs of fork-lift tine channels in the bottom, the two pairs being coplanar, perpendicular to one another, and intersecting one another, the fork-lift tine channels being shaped to prevent contact of fork-lift tines therein with a bulk bag contained in the basket or, when the basket is stacked on a like basket, a bulk bag contained in the like basket.

4. The apparatus of claim 3, further comprising:

lifting-eye means in at least two of the collapsible side walls, the lifting-eye means projecting above the basket a height less than the height of the fork-lift tine channels.

5. The apparatus of claim 2, further comprising:

slot means (24) for limiting movement of the basket when the basket is stacked upon another like basket.

6. The apparatus of claim 2, further comprising:

slot means (51) for engaging hydraulic wheels of a pallet jack.

7. The apparatus of claim 2, further including:

an opening in the bottom to accommodate a nipple of a bulk bag.

8. The apparatus of claim 2, further comprising a bulk bag in the basket.

9. The apparatus of claim 2, further comprising a second portable, collapsible basket.

10. The apparatus of claim 2, further comprising a plurality of portable, collapsible baskets.

11. The apparatus of claim 2, wherein the collapsible walls are all below the upper edge of the peripheral wall means when the collapsible walls are collapsed.

12. The apparatus of claim 2, further comprising:

lifting-eye means in at least two of the collapsible side walls.

13. A method of transporting bulk materials in a marine environment, comprising placing a bulk bag in the apparatus of claim 2 and attaching a lifting means to the apparatus of claim 2.

14. Apparatus for transporting bulk materials, comprising a portable, collapsible basket for bulk bags, the basket comprising:

(a) a bottom;

(b) four collapsible side walls, comprising two pairs of parallel side walls, each side wall including a wall portion having a length less than half that of the basket, the wall portions in the walls in each pair of side walls being diametrically opposed to one another, each wall also including a strap portion, the walls in each pair being able to fold downward side-by-side;

(c) an open top;

(d) a peripheral wall means adjacent the bottom;

(e) first pin means pivotally connecting each collapsible side wall to the peripheral wall means;

(f) means for detachably connecting each collapsible side wall to the peripheral wall means; and (g) fork-lift tine means for allowing the basket to be transported with a fork lift, comprising two pairs of fork-lift tine channels in the bottom, the two pairs being coplanar, perpendicular to one another, and intersecting one another, the fork-lift tine channels being shaped to prevent contact of fork-lift tines therein with a bulk bag contained in the basket or, when the basket is stacked on a like basket, a bulk bag contained in the like basket;

(h) first slot means (24) for limiting movement of the basket when the basket is stacked upon another like basket;

(i) second slot means (51) for engaging hydraulic wheels of a pallet jack;

(j) lifting-eye means in at least two of the collapsible side walls; and (k) an opening in the bottom to accommodate a nipple of a bulk bag.

15. The apparatus of claim 14, further comprising a bulk bag in the basket.

16. The apparatus of claim 14, further comprising a second portable, collapsible basket.

17. The apparatus of claim 14, further comprising a plurality of portable, collapsible baskets.

18. The apparatus of claim 14, wherein the collapsible walls are all below the upper edge of the peripheral wall means when the collapsible walls are collapsed.

19. A method of transporting bulk materials in a marine environment, comprising placing a bulk bag in the apparatus of claim 14 and attaching a lifting means to the apparatus of claim 14.

* * * * *